US005154130A

United States Patent [19]

Gribetz et al.

[11] Patent Number: 5,154,130

[45] Date of Patent: Oct. 13, 1992

[54] MULTI-NEEDLE DOUBLE LOCK CHAIN STITCH TACK, JUMP AND THREAD TRIMMING QUILTING METHOD AND APPARATUS

[75] Inventors: Michael J. Gribetz, Fort Lauderdale; Glenn E. Leavis, Hollywood; Michael A. James, Sunrise, all of Fla.

[73] Assignee: Leggett & Platt, Incorporated, Carthage, Mo.

[21] Appl. No.: 768,835

[22] Filed: Sep. 30, 1991

[51] Int. Cl.[5] ..... D05B 65/02

[52] U.S. Cl. ..... 112/292

[58] Field of Search ..... 112/292, 295, 298, 197, 112/199, 285, 291, 293, 296

[56] References Cited

U.S. PATENT DOCUMENTS

| | | | |
|---|---|---|---|
| 2,358,878 | 9/1944 | Pikul | 112/298 |
| 3,381,655 | 5/1968 | Davy | 112/298 |
| 4,098,209 | 7/1978 | Schopf | 112/298 |
| 4,461,229 | 7/1984 | Angele et al. | 112/295 X |
| 4,726,305 | 2/1988 | Seto | 112/298 |

OTHER PUBLICATIONS

Brochure, "Union Special® Stitch Formation" Type 401, Technical Training Center, 12005 4th Street, Huntley, IL 60142.

Brochure, "GI-4300-WCS TM Class IV Computer Driven Double Lock Chain Stitch Quilter", Gribetz International, Inc., 13800 Northwest 4th Street, Sunrise, FL 33325.

*Primary Examiner*—Werner H. Schroeder
*Assistant Examiner*—Paul C. Lewis
*Attorney, Agent, or Firm*—Wood, Herron & Evans

[57] ABSTRACT

An automatic thread trimming method and apparatus are provided for tack and jump sewing of fabrics. In a preferred embodiment, a quilting apparatus having a plurality of sets of, preferably, double lock chain stitch forming elements, is disposed on a mechanically linked mechanism in a reconfigurable array corresponding to an array of discrete patterns to be sewn. Each set of the array is equipped with a thread trimming element. In a preferred embodiment, a thread trimming cutting edge is formed on one surface of a thread stitch forming element, preferably on a revolving retainer element that is mechanically linked to the mechanism. When operated in a forward direction, a chain stitched pattern is sewn with the stitches formed in cooperation with the retainer revolving in a forward direction. Upon completion of the pattern, the mechanism is reversed for half of a cycle to bring the cutting edge against a thread, the thread tension is released, the fabric is advanced to pull the thread, the thread tension is reapplied to cause the thread to be cut, and the fabric is positioned for the start of a new discrete pattern.

24 Claims, 11 Drawing Sheets

MULTI-NEEDLE DOUBLE LOCK CHAIN STITCH TACK, JUMP AND THREAD TRIMMING QUILTING METHOD AND APPARATUS

The present invention relates to multiple needle chain stitch quilting, and particularly to methods and apparatus for sewing, tacking, cutting and repositioning the stitching elements with respect to the fabric for a continuous application of arrays of separated double lock chain stitched patterns in the manufacture of quilted material.

BACKGROUND OF THE INVENTION

In sewing applications such as the automated stitching of repeated discrete patterns onto fabrics, it is frequently necessary, upon completion of the sewing of one pattern, to tack or repeat sew the thread at the tail end of the pattern and then advance the sewing needle to the beginning of the next pattern, and to trim the thread between the two patterns, particularly on the front or visible face of the fabric.

In the manufacture of quilted fabrics in which, for example, a cover, a liner and one or more layers of filling material are joined to form an article such as a quilted furniture or mattress cover, automated sewing machinery is commonly employed to sew the layers of material together, with stitching applied in repeated patterns, or arrays of repeated patterns. High speed and economic production of such quilted fabrics generally requires equipment utilizing entire arrays of needles, ganged together and driven through a common stitch forming mechanism, to apply a plurality of patterns simultaneously in a predetermined array. Frequently, the preferred stitch for this purpose is a chain stitch such as a standard 401 double lock chain stitch. Usually, running lengths of these quilted fabrics are sewn and wound into rolls and subsequently cut to size. The double lock chain stitch is preferred for this purpose because it is elastic, and does not unravel or run when cut.

Machines for sewing double lock chain stitches employ three stitch forming elements to guide and loop the threads in the formation of a stitch. One of these elements is a needle, which cyclically reciprocates through the fabric, usually from above a fabric as it is moved over a horizontally disposed needle plate, for feeding loops of a top or needle thread, carried by the needle eye, through the fabric. The second element is conventionally referred to as a looper, which oscillates in synchronism with the needle and applies a bottom or looper thread from below the plate by feeding loops of a looper or bottom thread through the needle thread loop as the needle descends below the plate on which the fabric is supported during each stitch cycle. The third element is commonly called a retainer, which moves horizontally in a cyclic motion in a plane below the plate and between the other elements to guide or horizontally displace a portion of the threads to spread the threads, allowing the descending needle to pass through a portion of the previous stitch, to thereby allow the consecutive stitches to be formed in a characteristic interlocking manner.

The more desirable automated quilting machines for quilting in patterns provide structure for supporting multiple sets of the stitch forming elements in arrays that correspond to the spacing of the patterns to be formed on the fabric. Preferably, the arrays in which the elements are supported can be selectively rearranged on with equipment that provides for a plurality of element mounting positions disposed in a closely spaced matrix. Such positions must be closely spaced to allow for flexibility in the layout of a multiplicity of pattern arrays, as well as to sew patterns with relatively close spacing.

Where discrete or disconnected patterns are to be sewn, trimming of the threads is highly desirably, particularly on the front or visible face of the fabric. In machines with single needle mechanisms, solenoid actuated thread cutoffs can be employed, but in the ganged multi-needle chain stitch machines, particularly those in which the sewing element sets are disposed closely or in reconfigurable arrays, where the elements are either many in number or must be easily rearranged, thread trimming has been accomplished downstream of, and subsequent to, the sewing operation, and often by hand.

Accordingly, there is a need for a method of efficiently trimming the threads in an automated quilting process and for a simple, compact and efficient apparatus for trimming threads, particularly where multiple discrete double lock chain stitched patterns are to be automatically sewn in arrays.

SUMMARY OF THE INVENTION

It is a primary objective of the present invention to provide a method and apparatus for trimming thread between the formation of discrete patterns in the sewing of quilted fabrics.

It is a more particular objective of the present invention to provide a thread trimming apparatus and trimming method for multiple needle pattern sewing operations, particularly those by which patterns are applied in dense arrays.

It is a further objective of the present invention to provide for the automated trimming of threads with a minimum addition of structure or control elements to the sewing equipment.

It is a particular objective of the present invention to provide for automatic thread trimming in multi-needle double lock chain stitch quilting machines employed to simultaneously sew arrays of discrete patterns using closely or flexibly positioned arrays of stitch forming elements.

According to the principles of present invention, a multi-needle quilting apparatus, particularly of the type having ganged arrays of needles and associated stitch forming elements, is provided with an array of corresponding thread trimming elements. In its preferred application, each of the sets of stitch forming and trimming elements are disposed in the array and are selectively positionable therein so as to define different arrays of patterns to be stitched on the fabric to be quilted.

In accordance with further principles of the invention, a stitch trimming element of the preferred embodiment is mechanically linked to, and preferably formed of, one of the stitch forming elements, and is operable to trim a thread when the element is subjected to a motion different from the motion of the element during regular stitch forming cycles.

In one preferred embodiment of the present invention, in which the quilting apparatus is provided with an array of selectively positionable sets of stitch forming elements, including a needle, a looper and a retainer that are mechanically linked together to produce a lock chain stitched pattern, an edge of the retainer is formed into a cutting edge which does not contact the threads when the elements are operated in a regular stitching cycle, but engages threads for cutting when the elements are driven in a reverse direction.

Further in accordance with a preferred embodiment of the invention in which a quilting apparatus operates by driving the stitch forming elements through a sequence of cycles, each forming a stitch, and moves the fabric relative to the sets of elements to stitch patterns on the fabric under programmed control, such as may be provided with a computer or other programmable controller, that controls the motion of the fabric in synchronism with the cycling of the stitch forming elements, discrete stitched patterns are formed on the fabric by tacking the threads and trimming the threads, or at least the top thread, as the fabric is moved with respect to the needles to bring each needle of the stitching element array to the starting point of a new pattern.

Preferably, after a pattern is sewn and the threads are tacked, the stitching elements move to a point in the stitching cycle in which the needle is above the fabric. The fabric is then rendered immoveable and the stitch forming elements are released from synchronized motion with the fabric movement drive. Then, the elements are further moved forward through one half of a cycle to lower the needle, extending it through the fabric, and allowing the looper to catch the needle thread below the needle plate. Then the tension on the threads is released and the mechanism driving the stitch forming elements is reversed, backing the elements to the point in their cycle at which the needle is raised, but with the needle thread extending through the fabric and hooked around the looper on the fabric back side. The reverse motion causes the retainer to cycle backward, bringing the threads into contact with a trimming surface of a knife edge formed thereon. Then the fabric is moved, without tension on the threads, to pull the threads along the trimming surface or edge of the retainer to form a sufficient tail of thread so that the cut threads will not snap back and unthread the needle. After movement of a predetermined distance, for example of about 1 ¼", the tension of the thread to be cut, which may be only the top or needle thread, is increased to a maximum as the fabric is advanced further, preferably toward the beginning of the next pattern, thereby causing the needle thread to be drawn tightly against the trimming surface or knife edge and trimmed at a point on the back side of the fabric.

With the present invention, thread trimming of at least the top thread is accomplished automatically. In the preferred embodiment of the invention, no thread contacting elements or mechanical structure need be added to a multi-needle lock chain stitch quilting machine. Only a cutting edge need be formed on the existing stitch forming retainer elements. Accordingly, reconfigurable arrays of stitch forming elements are not complicated by the addition of scissors or other trimming elements, and a thread trimming function is provided with structure that can be located in a tightly packed array of stitching element positions in the stitch forming mechanism. The trimming elements can thereby be selectively repositioned as the array is redefined with no additional effort than is required to set the positions of the elements that form the stitches. Additional structure for performing the trimming operation, which may include solenoids for releasing and engaging the fabric movement drives and for releasing and reapplying tension to the threads, can be located remote from the stitch forming element movement mechanism.

These and other objectives and advantages of the present invention will be more readily apparent from the following detailed description of the drawings of the preferred embodiment of the invention, in which:

DETAILED DESCRIPTION OF THE DRAWINGS

Figure 1:
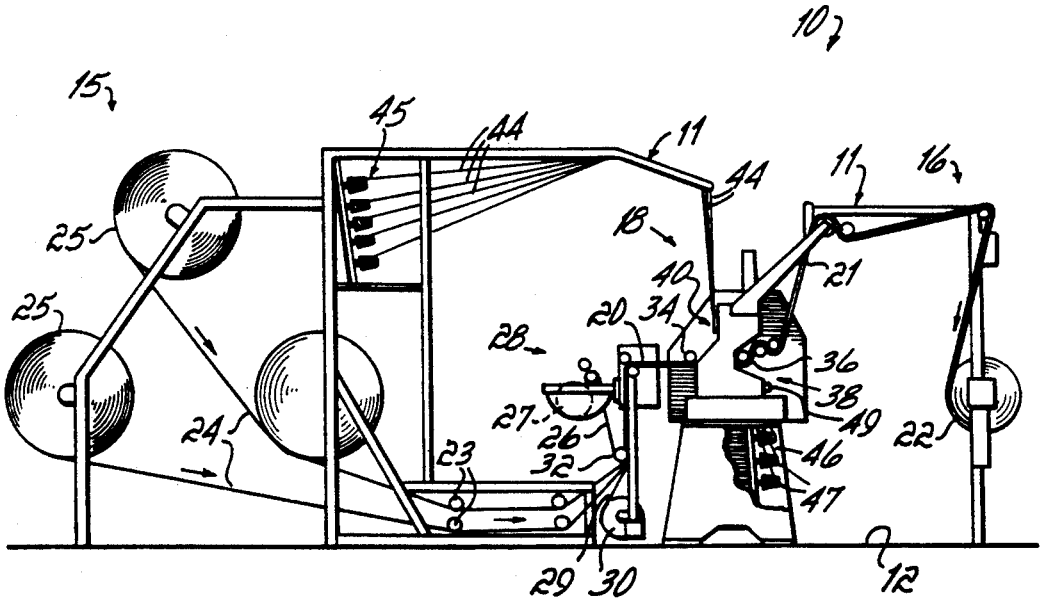
FIG. 1 is an elevational view of a double lock chain stitch quilting machine embodying principles of the present invention.

Referring to FIG. 1, a double lock chain lock stitch quilting machine 10 according to one embodiment of the present invention is illustrated. The machine 10 includes a frame 11 assembled in one or more components on a plant floor 12. Assembled to the frame 11 are a fabric material supply station 15 at the upstream end of the frame 11, a quilt take-up station 16 at the downstream end of the frame 12, and a quilting station 18 between the supply station 15 and the take-up station 16.

At the quilting station 18, a stitch pattern is applied to a multiple layered fabric 20 to form a quilt 21, which then passes to the take-up station 16 where it is wound upon a take-up roll 22, which is rotatably supported on a transverse axle to the frame 11 at the take-up station 16. The fabric 20 is formed of one or more layers of filler material 24 from supply rolls 25 mounted on horizontal transverse axles to the frame 11 at the supply station 15. The filler material 24 is fed downstream from the supply station 15 around guide rollers 23 and between two layers of cover material, including an outer cover 26 from a supply roll 27 lying in a trough mounted to the frame 11 above the flights of filler material 24 at the entry end 28 of the quilting station 18, and a liner or backing 29 from a supply roll 30, rotatably mounted on a transverse axle to the frame 11 below the filler material 24 at the entry end 28 of the quilting station 18.

The layers of material 24, 26 and 29 are brought together at a roller station 32 at the entry end 28 of the quilting station 18, to form the fabric 20. The roller station 32 includes two pair of transversely extending, transversely shiftable, reversible feed rollers 34, adjacent the entry end 28 of the quilting station 18 through which the fabric 20 passes before entry into the quilting station 18. The rollers 34 are driven in synchronism with cooperating exit feed rollers 36 at the exit end 38 of the quilting station 18 rotating or transversely shifting together, to advance, reverse and transversely shift the fabric 20 as it moves through the quilting station 18.

At the quilting station 18, the fabric 20 is sewn, with a stitch forming mechanism 40 (shown in detail in FIG. 2) into arrays 43 of quilted patterns 41 or 42 (FIGS. 4A and 4B) from a plurality of needle threads 44, from a plurality of needle thread spools 45 mounted on the frame 11 near the supply station 15, and a plurality of looper threads 46, from a plurality of looper thread spools 47 mounted on the frame 11 beneath the quilting station 18.

The needle threads 44 pass through a bank of thread tension adjusters 48 at the front side of the frame 11 at the quilting station, prior to passing to the quilting mechanism 40. These adjusters are mechanically settable to provide proper thread tension. They are also controlled by pneumatic solenoid controlled actuators to switch between a tension state, at which the set tension is applied to the needle threads 44, and a release state, at which no tension or minimum tension is applied to the threads 44.

In the alternative to the tension application and release actuating feature of the adjusters 48, separate thread clamps may be provided in the form of a clamp bar 48*a* in a position along the thread as close as possible to the needles of the mechanism 40. The desired proximity of the release actuators, which would switch between minimum and maximum thread tension, is dependent on the elasticity of the thread, and is selected to avoid thread snap-back and unthreading of the needles. The greater the thread elasticity, the closer the clamp or release actuators should be to the needles. With many thread types, the thread tensioners may contain the release and clamp actuators as illustrated in the embodiment of FIG. 1.

Similarly, looper thread tensioners and tension release actuators 49 are provided on the frame 11 at the back of the quilting station 18 between the looper thread supply spools 47 and loopers of the stitch forming mechanism 40.

Figure 2:
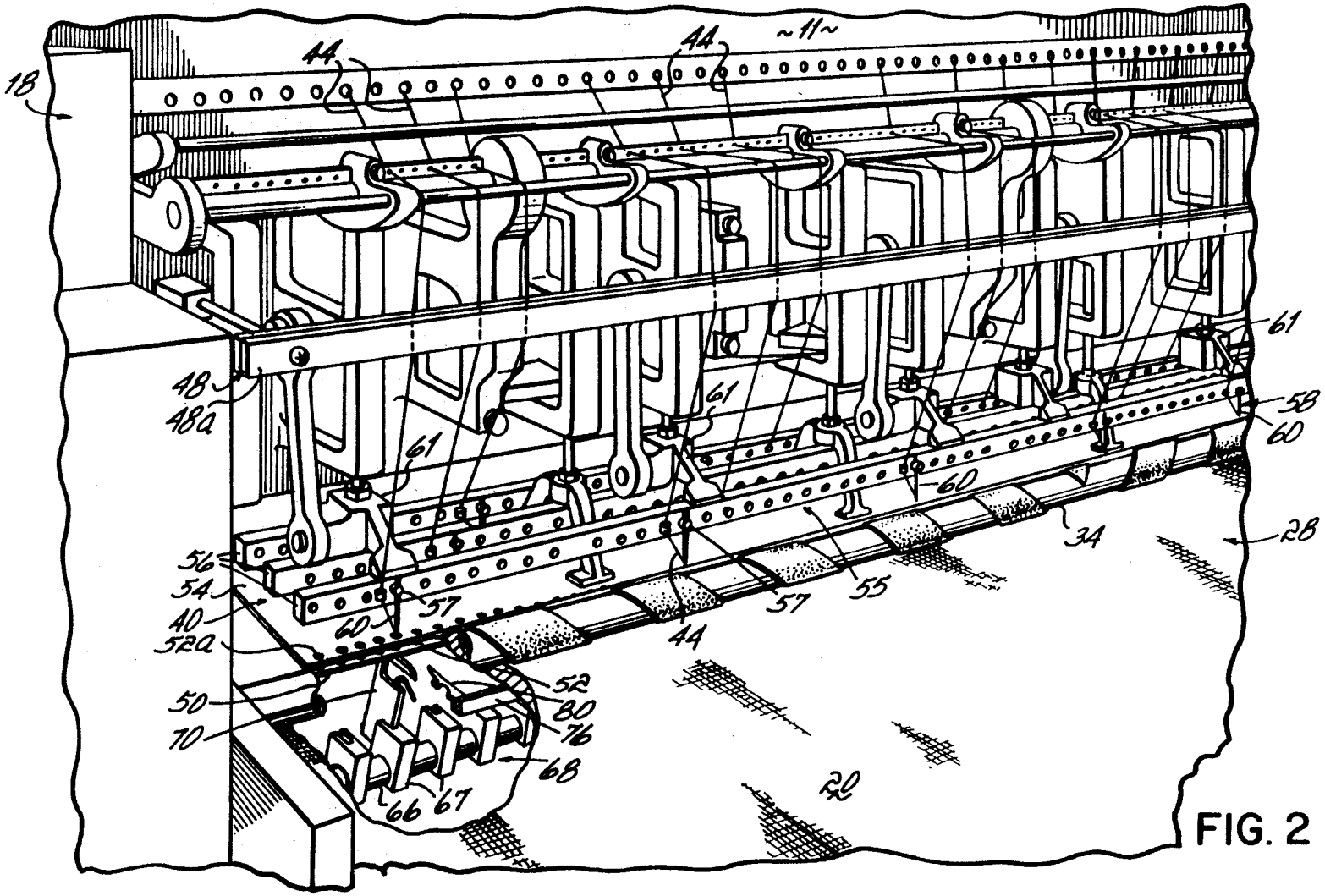
FIG. 2 is an isometric view, partially diagrammatic and partially broken away, depicting the stitch forming elements and the relative movements of the fabric and machine components in the machine of FIG. 1.
Figure 3:
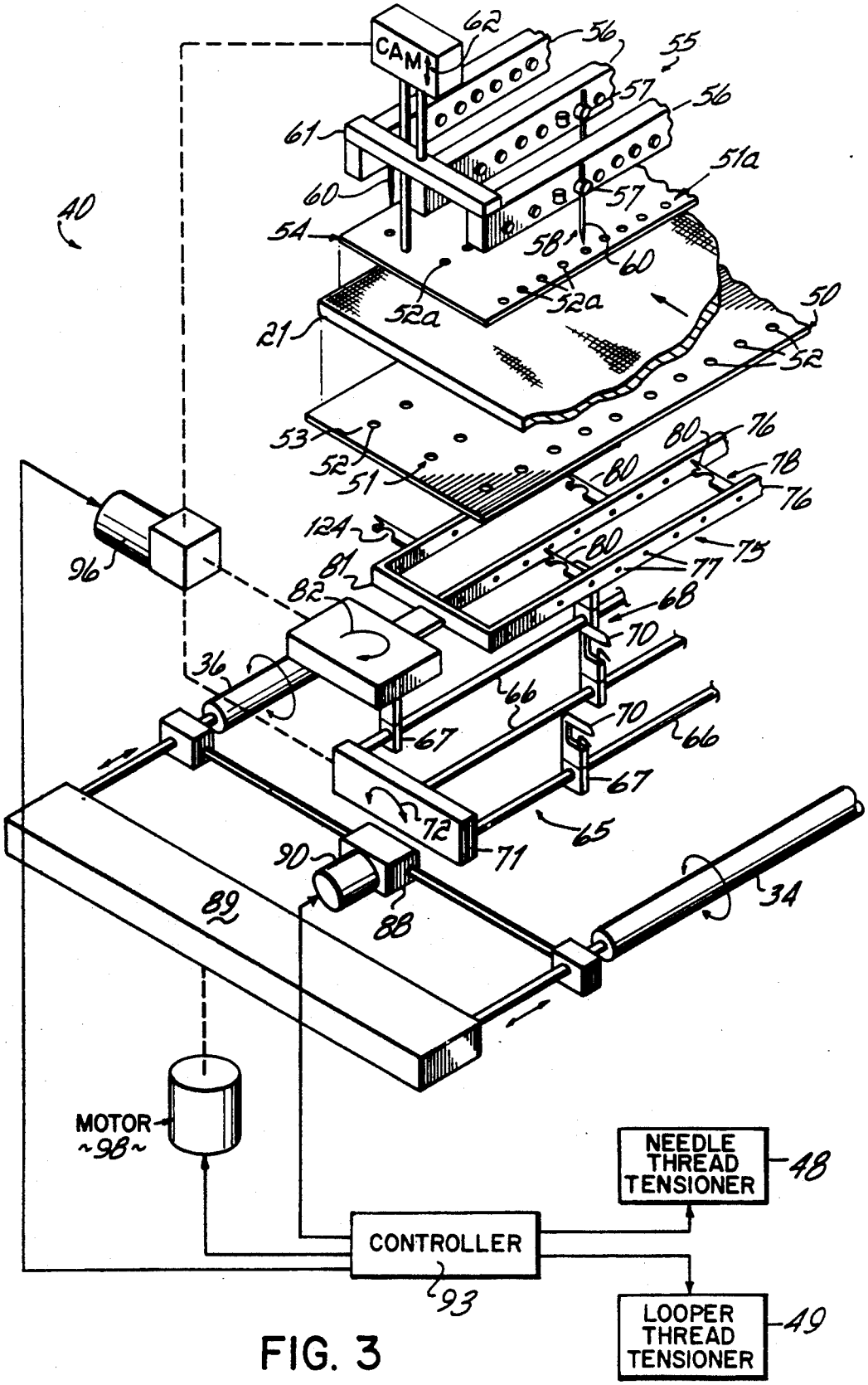
FIG. 3 is a diagrammatic disassembled perspective view illustrating the machine components and the relationship of the control actuators and drives in the machine of FIG. 1.

As illustrated in FIGS. 2 and 3, the stitching mechanism 40 of the quilting station 18 includes a plurality of stitch forming elements positioned above and below a needle plate 50. The plate 50 supports the fabric 20 as patterns, such as pattern 42, are stitched on it to form the quilt 21. The plate 50 has a matrix 51 of needle receiving holes 52 therein spaced approximately one inch apart in three parallel rows 53, spaced about six inches apart. A presser plate 54, which is located above the plate 50, moves down to press the fabric 20 against the plate 50 to hold the fabric as the needle is extended through it, and moves up to allow the fabric 20 to be moved. The presser plate 54 also has a matrix 51*a* of holes 52*a* therein which correspond to the matrix 51 of needle holes 52 in the plate 50.

Positioned above the rows 53 of holes 52 of the plate 50 is a set 55 of three parallel transversely oriented and longitudinally spaced needle support bars 56, each having a matrix of needle holders 57 thereon corresponding to, and spaced directly above, each of the holes 52 in the matrix 51 in the needle plate 50. Each of the holders 57 includes a vertical groove in the front face of the bar 56 and a clamping screw positioned in a threaded hole beside the groove to clamp against a flat face of the shank of the needle positioned in the groove to hold the needle securely in position. Mounted in selected ones of the holders 57 is a needle array 58 of a plurality of needles 60, so positioned to define the relative spacings of patterns, such as pattern 42 a pattern array 43. The needle bars 56 are ganged through cross members 61, mounted to reciprocate vertically on the frame 11 at quilting station 18, to move up and down on the frame 11, as shown by the arrow 62, so that each of the needles 50 passes through a corresponding hole 52 in the needle plate 50.

Positioned beneath the rows 53 of holes 52 of the plate 50 is a set 65 of three parallel transversely oriented and longitudinally spaced looper support rods 66, each having a plurality of looper holders 67 thereon corresponding to, and spaced directly below, each of the holes 52 in the matrix 51 of holes 52 in the needle plate 50. Mounted in selected ones of the holders 67 is a looper array 68 of a plurality of loopers 70, so positioned to correspond one to each of the needles 60, in approximately vertical but exact alignment therewith. The looper bars 66 are pivotally mounted to the frame 11 at quilting station 18 and linked through cross linkage 71 to oscillate in synchronism in a longitudinal vertical plane in which a corresponding one of the needles 60 and holes 52 lie, as shown by the arrow 72.

Positioned approximately 1/32" beneath the plate 50, adjacent the rows 53 of holes 52 of the plate 50, is a set 75 of three parallel transversely oriented and longitudinally spaced retainer support strips 76, each having a plurality of threaded retainer mounting holes 77 thereon corresponding to, and spaced below and adjacent, each of the holes 52 in the matrix 51 in the needle plate 50. Mounted with screws at selected ones of the holes 77 is a retainer array 78 of a plurality of retainers 80, so positioned to correspond one to each of the needles 60 and loopers 70. The retainer strips 76 are ganged together by linkage 81, in the form of rigid bars, to move in synchronism to carry each of the retainers 80 in small circles of approximately ⅜th inch in diameter, as shown by arrow 82, in a horizontal plane below the plate 50.

The needle bars 56, looper rods 66 and retainer strips 76, and the cross members and linkages 61, 71 and 81 that respectively join them, are linked together and driven by the common stitching mechanism 40. The mechanism 40 moves cyclically so as to move the stitch forming elements, which include the needles 60, the loopers 70 and the retainers 80, in one stitch forming cycle for each cycle of the mechanism 40, thereby forming one stitch of a pattern.

Figure 4B:
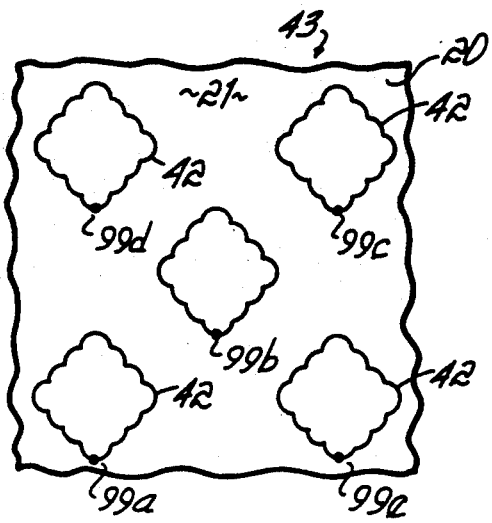
FIG. 4B is a plan view, similar to FIG. 4A but at approximately twice the scale, of the front side of a fabric quilted with an array of discrete 360° patterns, according to principles of the present invention, on the quilting machine of FIG. 1.
Figure 4A:
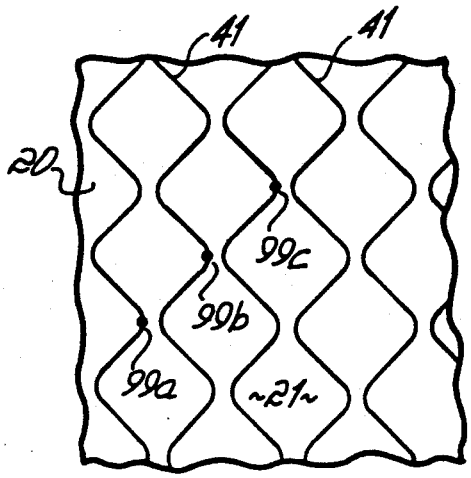
FIG. 4A is a plan view of the front side of a fabric quilted with a continuous pattern on the quilting machine of FIG. 1.

FIG. 4A illustrates an array of continuous patterns 41 that can be formed on the machine 10 of FIG. 1. This figure shows how a pattern 41 will be formed by one needle 52 on each of the needle bars 56, each needle 52 being spaced transversely to overlie points 99*a*, 99*b* and 99*c*.

The array 43 of discrete patterns, such as the patterns 42 of FIG. 4B, is the type to which the present invention in primarily useful. As shown in FIG. 4B, the three needle positions 99*a*, 99*b* and 99*c*, plus two needle positions 99*d* and 99*e*, combine to form five patterns 42 of the array 43 in the segment of the quilt 21 illustrated. The closed 360° pattern 42 is achieved by programmed motion of the fabric 20 transversely and longitudinally by motion of the feed rollers 34 and 36 in synchronism with the operation of the stitch forming mechanism 40, to form stitches, preferably of equal length in the pattern shape. The 360° patterns 42 of the array 43 are accomplished by forward and reverse rotation of the feed rollers 34 and 36 as well as transverse reciprocating motion of the rollers 34 and 36. The discrete character of the patterns 42 of FIG. 4B involves the formation of several tack stitches upon the completion of a pattern 42, a cutting of at least the top or needle threads 44, and a repositioning of the fabric 20 under the needles 60 for the beginning of the next pattern.

The formation of the patterns, for example pattern 42, is achieved by the motion of the fabric 20 with respect to the needle holes 52 in the plate 50. This fabric motion is accomplished by the feed rollers 34 at the entry end 28 of the quilting station 18 and the identical motion of the feed rollers 36 (FIG. 1) at the exit end 38 of the quilting station 18. Both of the sets of feed rollers 34 and 36 are driven in synchronism by the a feed roller movement mechanism that includes a roller reversible rotary drive 88, shown schematically in FIG. 3. The reversibility of the drive 88, and the ability to pull the fabric 20 from the front by rollers 34 as well as from the back by rollers 36, provides an ability to form 360° patterns such as pattern 42.

The rollers 34 and 36 are also shiftable transversely, in synchronism with each other, by transverse roller drive 89. These roller drives 88 and 89 are electronically linked to the stitch forming mechanism 40 by a controller 93. The rotary feed drive 88 is driven by feed motor 90 while the transverse drive 89 is driven by shift motor 98. The ratio and relative direction of the drives 88 and 89 and the mechanism 40 is controlled in response to a computer, containing a pattern program, within the controller 93. The drives 88 and 89 and the motors 90 and 98 can be driven in synchronism with, or disengaged from, the mechanism 40, which is driven by a separate drive motor 96. Each motor and the respective drives 88, 89 and the mechanism 40 can thus be locked in position while the others are activated, under control of the controller 93.

Figure 5A:
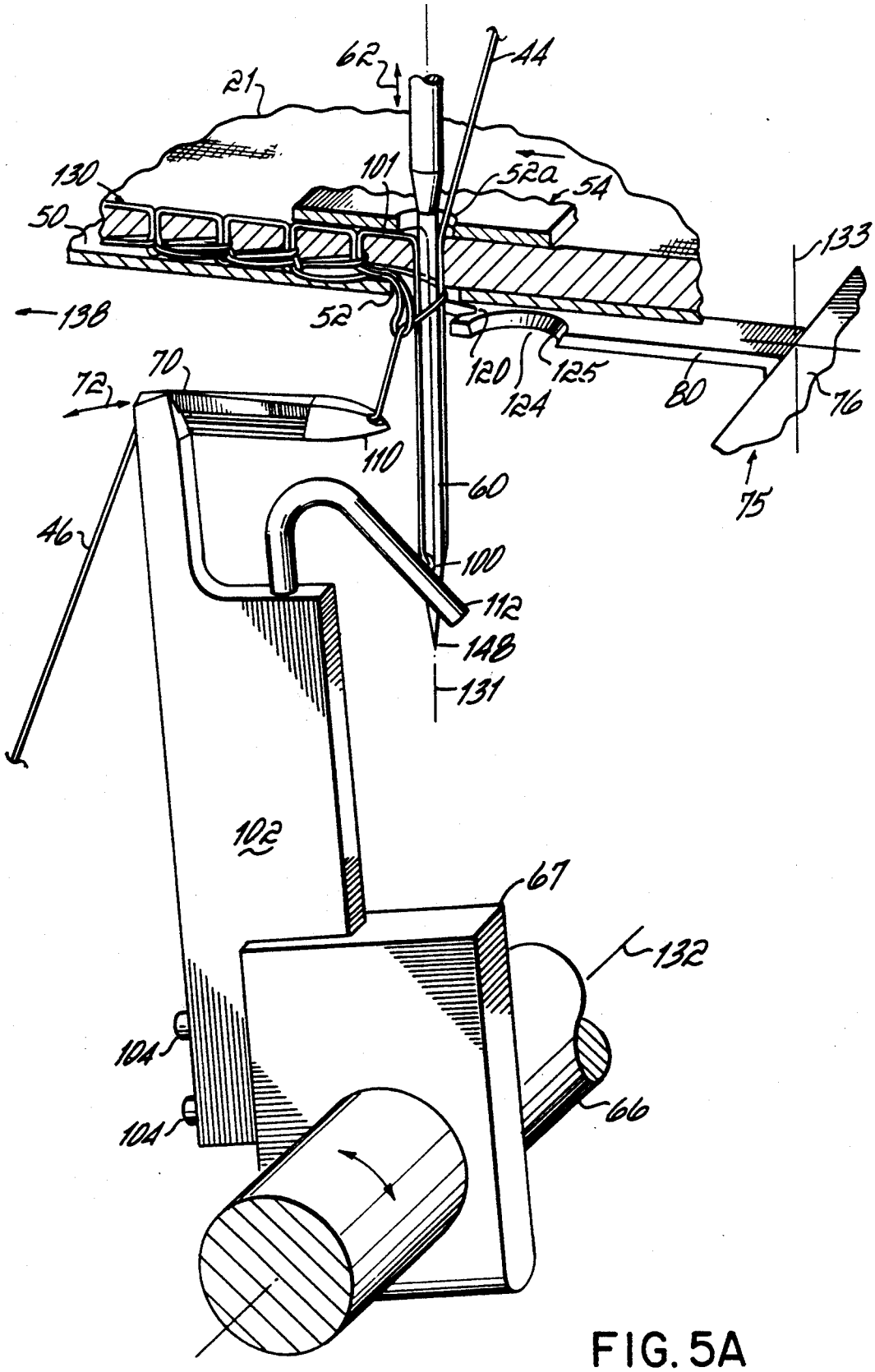
FIG. 5A is an enlarged perspective view of one set of the stitch forming elements, including a needle, needle plate, looper and retainer, and illustrating the formation of a modified 401 double lock chain stitch, with the needle shown in fully down or bottom dead center (BDC) position. For purposes of reference, this position is defined as the 0° or 360°, position of the stitch forming elements, at the beginning and end of a stitch forming cycle.

FIG. 5A illustrates in detail a corresponding set of the stitch forming elements located at corresponding points in the arrays 58, 68 and 78. These elements include needle 60, looper 70 and retainer 80 shown at corresponding points in their stitch forming cycle, with the needle 60 in its lowermost, or bottom dead center (BDC) position, extending through the fabric 20 and hole 52 in the plate 50. At this position, the looper 70 is in its rearwardmost position while the retainer 80 is in its rightmost position.

As shown in FIG. 5A, needle 60 is mounted in holder 57 on one of the bars 56. An eye 100 is at the lower end of the needle 60, and through it extends needle thread 44 from supply spools 45 and, on the opposite side of the needle 60, to the last formed lock stitch 101. The looper 70 is formed of a block 102 that is detachably secured with screws 104 to a holder block 67 fixed to a looper rod 66. The looper 70 has a longitudinal bore therethrough through which looper thread 46 from the looper thread supply spools 47 enters from the back and emerges at the tip 110 thereof from which it extends to the last formed lock stitch 101. To the looper block 102 is fixed a needle anti deflection guide 112. The retainer 80 is mounted at its forward end to a retainer holder 77 on a retainer strip 76, and has at its rearward end a notch 120, which is better seen in subsequent figures described below. The retainer also has on its left edge a semicircular cutout 124 formed to a sharp cutting edge 125.

The operation of the stitch forming elements is during the stitch forming cycles that form the stitches that make up the patterns is illustrated in FIGS. 5A through 5G, and corresponding FIGS. 7A through 7G. The preferred stitch for forming the quilts 21, and that illustrated in the drawings, is the type 401 chain lock stitch, as defined in U.S. Government Specification 751a, or a modification thereof.

In beginning a pattern array, such as the array 43 of the discrete patterns shown in FIG. 4B, with the needles 60 entirely up in a top dead center (TDC) point in their cycle, the fabric 20 is positioned on the plate 50 such that the needles 60 and needle holes 52 align vertically with respective starting points, as for example 99*a*–99*c*, of each pattern 42. Then the stitching begins, forming a sewn sequence 130 of chain lock stitches as illustrated in FIG. 5A.

Figure 6A:
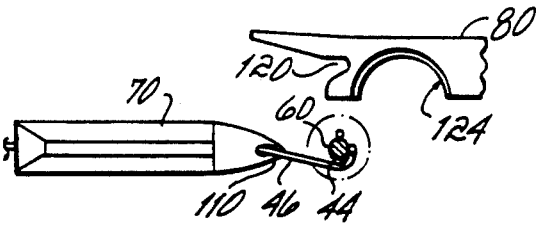
FIGS. 6A through 6G are top cross sectional views, taken along line 6—6 of FIG. 5A, each corresponding to FIGS. 5A through 5G, respectively.

In the position of FIG. 5A, the stitch forming elements 60, 70 and 80, together with the other mechanically linked components of the stitch forming element movement mechanism 40, are at a point in the stitch forming cycle illustrated in FIGS. 5A and 6A, with the needle 60 in its lowermost or BDC position, the looper 70 in its rearwardmost position, and the retainer 80 in its rightmost position when viewed downstream from the entry side 28 of the quilting station 18. For purposes of this description, this position is taken as the start, zero degree or reference position of the cycle. At this point, the last stitch 101 is completely formed but remains to be tightened.

As the stitch cycle progresses from the 0° position of FIGS. 5A and 6A, the needle 60 begins to move upward on its vertical axis 131 while the looper 70 begins to move forward, rotating about its horizontal axis 132. Simultaneously, the retainer 80 begins to revolve, or translate around a closed path while retaining its orientation. In the embodiment shown, this path is a circular motion in a clockwise direction in a horizontal plane about a vertical axis 133.

Figure 5B:
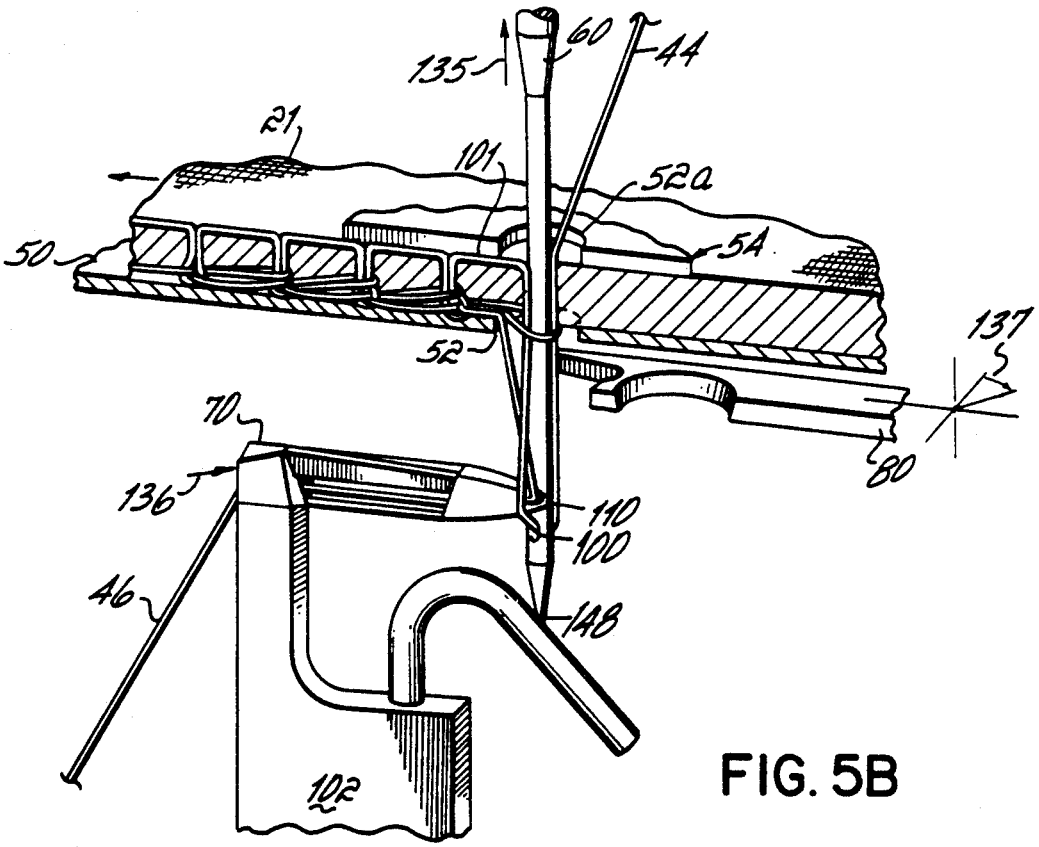
FIG. 5B is a view similar to FIG. 5B with the needle advanced forward 40° from the zero position in the stitch forming cycle.
Figure 6G:
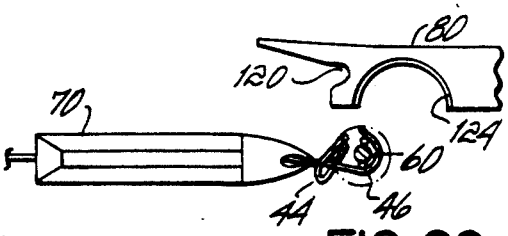
Figure 6B:
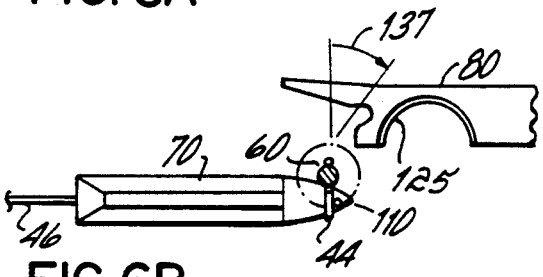

The motion of the needle 60, looper 70 and retainer 80, represented in FIGS. 5B and 6B by the arrows 135, 136 and 137 respectively, brings the elements to the positions illustrated in FIGS. 5B and 6B at approximately the 40° point in their cycle. At this point, the tip 110 of the looper 70 passes against the left side of the needle 60, between the needle thread 44 and the needle 60 on the stitch side of the needle 60, and the feed of the fabric 20 begins in the direction of the pattern as determined by the pattern control program in the controller 93, here shown as a downstream direction.

Figure 5C:
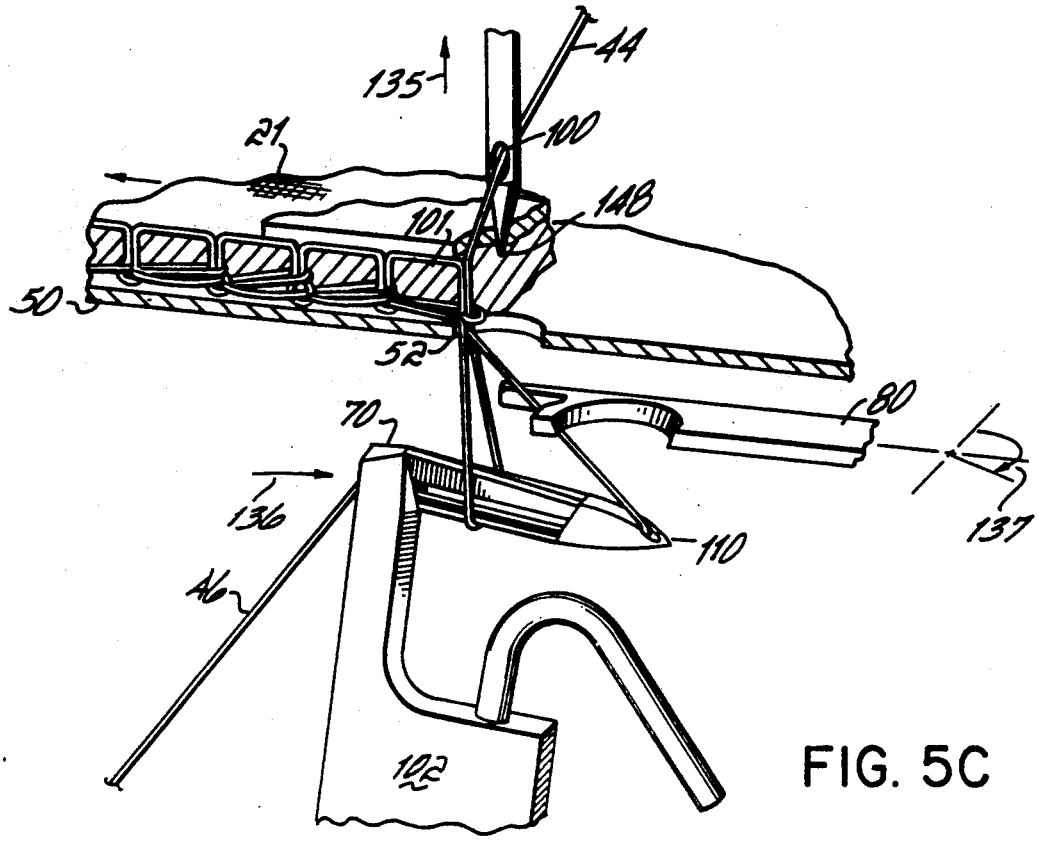
FIG. 5C is a view similar to FIG. 5B with the needle advanced forward 100° from the zero position in the stitch forming cycle.
Figure 6H:
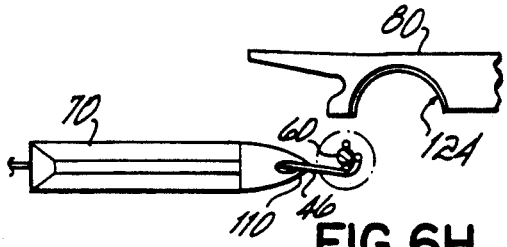
FIGS. 6H through 6K are top cross sectional views, taken along line 6—6 of FIG. 5A, each corresponding to FIGS. 5H through 5K, respectively.
Figure 6C:
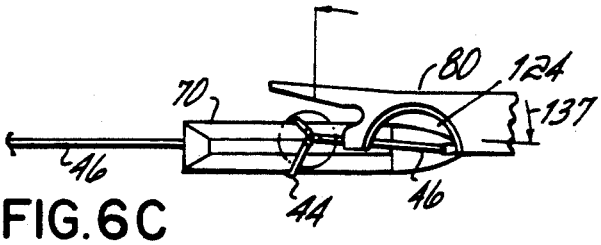

The motion continues, and, as shown in FIGS. 5C and 6C, approaches approximately the 100° point in the cycle, with the fabric moved approximately one-half stitch in relation to the needle 60. At this point, the looper thread 46, enters the notch 120 in the tip of the retainer 80, pulled forward by the tip 110 of the looper 70.

Figure 5D:
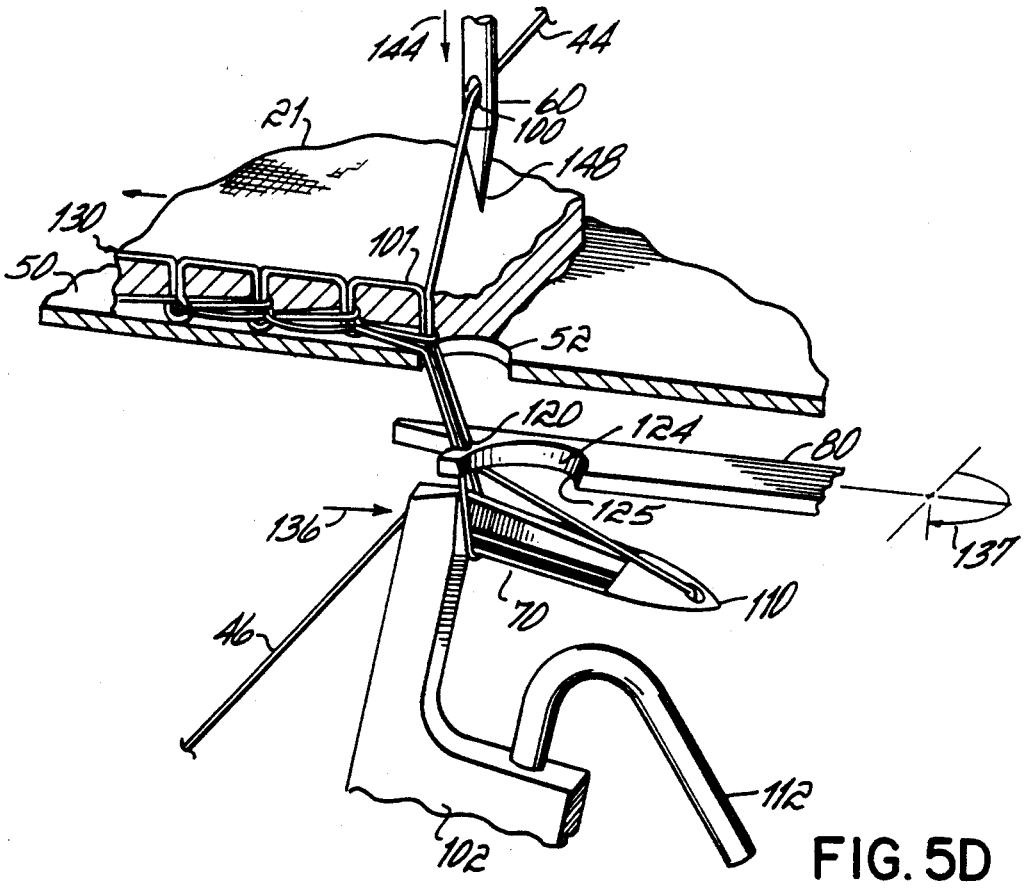
FIG. 5D is a view similar to FIG. 5B with the needle advanced forward 160° from the zero position in the stitch forming cycle.
Figure 6I:
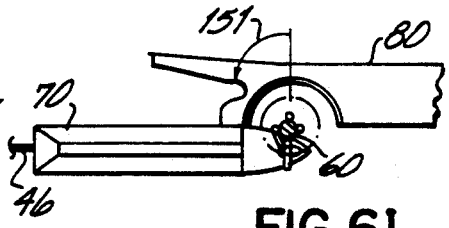
Figure 6D:
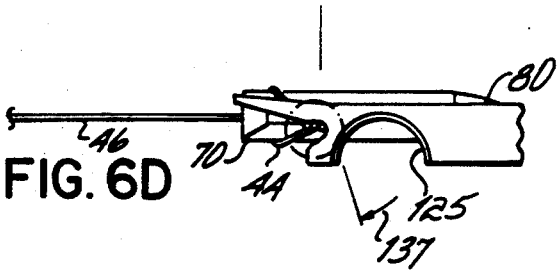

The motion further continues to the position shown in FIGS. 5D and 6D, approximately the 160° point in the cycle, which is about 20° before the needle 60 reaches its uppermost or TDC position, the looper 70 reaches its forwardmost position, and the retainer 80 reaches its left most position. At this point, the needle thread 44 also enters the notch 120 in the tip of the retainer 80.

Figure 5E:
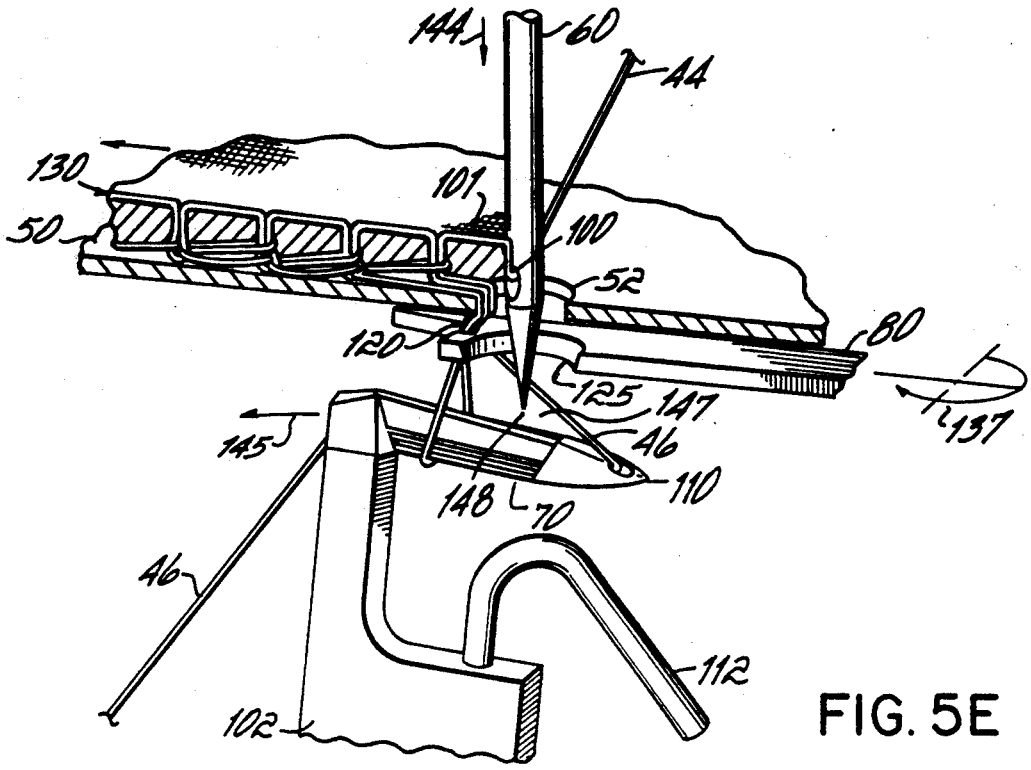
FIG. 5E is a view similar to FIG. 5B with the needle advanced forward 240° from the zero position in the stitch forming cycle.
Figure 6J:
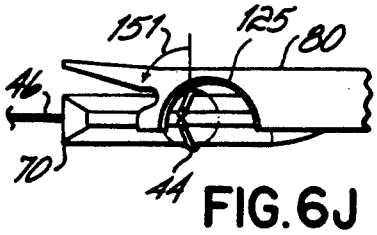
Figure 6K:
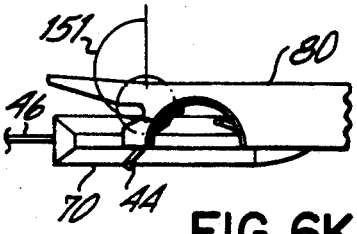
Figure 6E:
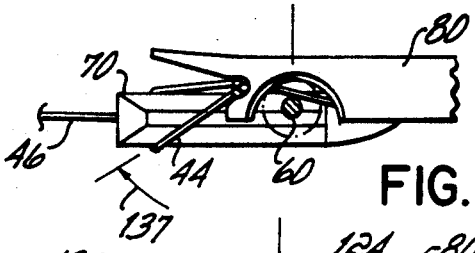

The motion continues with the needle 60 passing its TDC position and beginning its downward motion as shown by the arrow 144, as shown in approximately the 240° position in the cycle in FIGS. 5E and 6E. The looper 70 at this point is moving rearward, as shown by arrow 145, while the retainer 80 is moving toward the right, pulling the threads 44 and 46 to the right of the looper 70 and the needle 60, and opening a triangle 147 defined by the looper thread 46, the needle thread 44 and the looper 70.

Figure 5F:
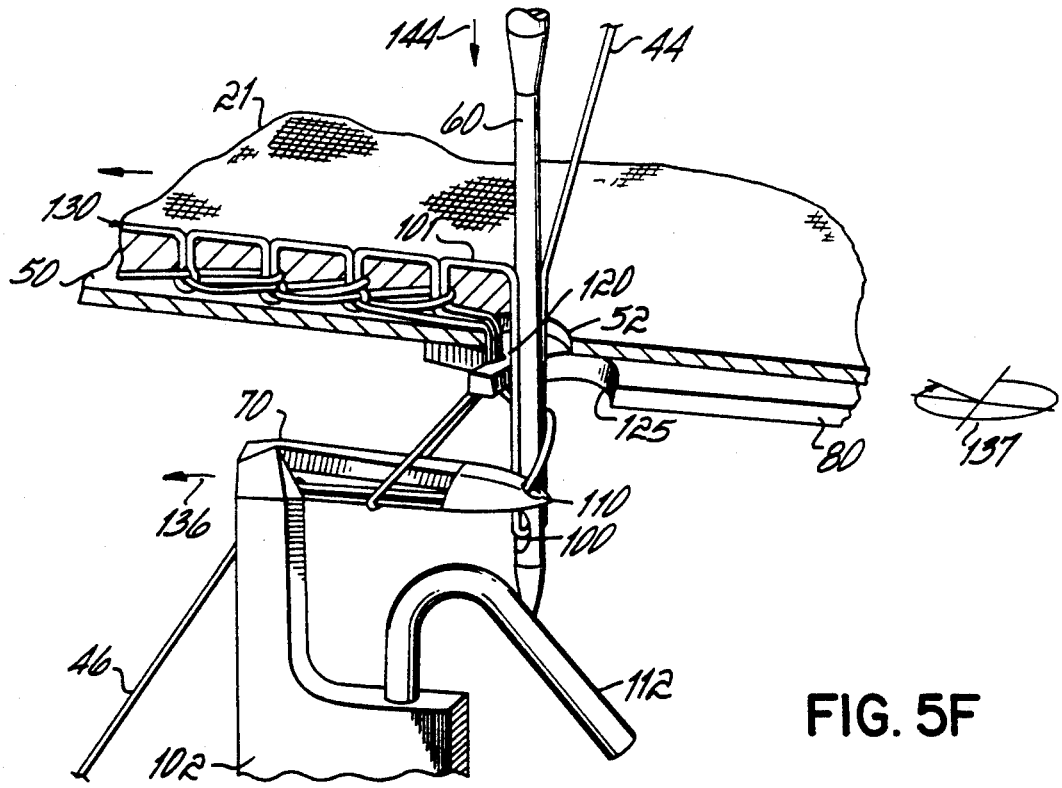
FIG. 5F is a view similar to FIG. 5B with the needle advanced forward 280° from the zero position in the stitch forming cycle.
Figure 5G:
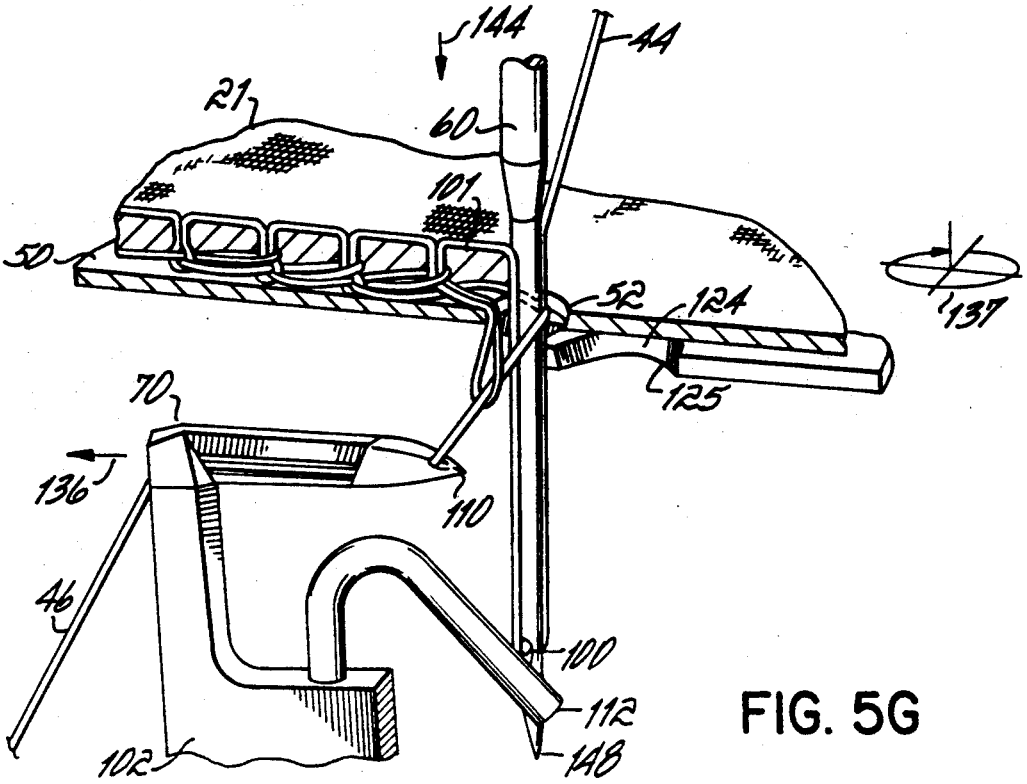
FIG. 5G is a view similar to FIG. 5B with the needle advanced forward 340° from the zero position in the stitch forming cycle, from which position the stitch forming elements advance again to the position of FIG. 5A.
Figure 6F:
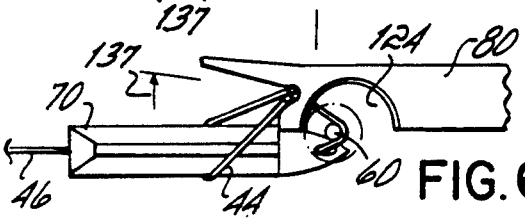

As the cycle continues, tip 148 of the needle 60 moves downward through the triangle 147, toward the position shown in FIGS. 5F and 6F, at which the elements are at the 280° position in the cycle. At this point, the tip 110 of the looper passes behind the needle 60, continuing to approximately the 340° position shown in FIGS. 5G and 6G, at which the needle thread 46 has slipped off the tip 110 of the looper 70 and around the looper thread 46, from which position the elements cycle again to the BDC position of FIGS. 5A and 6A.

The elements continue to cycle through the positions of FIGS. 5A through 5G, forming one stitch with each cycle. During these cycles, the roller feed drive 88 and roller shifting drive 89 move the fabric so as to cause the sewing of a programmed pattern. This roller movement is controlled by a program in the controller 93 which adjusts the ratio of the motion of the drive motors 90 and 98 so that the stitch forming elements scribe the desired pattern, such as pattern 42 shown in FIG. 4B, while maintaining all of the stitches at the same or programmed length.

When a set of discrete patterns 42 is completed, the program causes the execution of a tacking, cutting and repositioning operation which tacks the threads 44 and 46 at the end of the completed patterns 42, cuts the threads, or at least the needle thread, and positions the fabric 20 to bring the needles to the positions for the starting of a new set of patterns 42. The tacking procedure is carried out by the program causing the elements to operate through about four cycles to form a group of tack stitches 150 as shown in FIGS. 5H and 6H.

When the tack sequence is complete, the elements 60, 70 and 80 are further moved forward through about one half of a cycle, that is, to a 180° position, which is through and slightly beyond the positions shown in FIGS. 5A through 5D. This brings the needle 60 to its uppermost or TDC position. At this point, the drives 90, 96 and 98 and the driven mechanism 40 and rollers 34 and 36 stop, and controller 93 causes the motors 90 and 98 to lock the position of the fabric 20, disconnecting the linkage between the roller feed drive 88 and roller shifting drive 89 on the one hand and the stitch forming mechanism 40 on the other. The stitch forming mechanism 40, at this time, remains moveable, driven by the main drive motor 96. The fabric position is marked by storing the roller positions in a memory the controller 93, so that the position of the next set of patterns 42 can be properly located.

Then, the stitching mechanism 40 is driven by motor 96 through the second half of its forward cycle, through the positions shown in FIGS. 5E and 6E through 5G and 6G, to the BDC position of FIGS. 5A and 6A. When at the BDC position, the motor 96 and the mechanism 40 stop again and the thread tension actuators of the thread tensioners 48 or 48*a* and 49 are released, removing tension from the needle and looper threads 44 and 46.

Figure 5H:
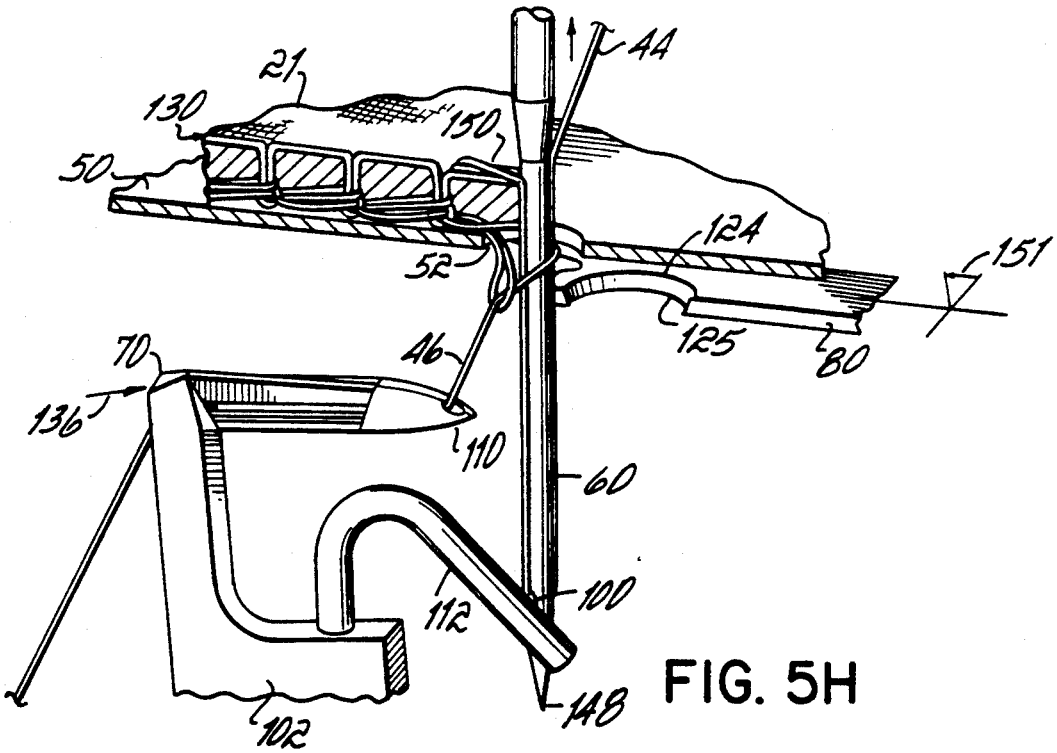
FIG. 5H is a view similar to FIG. 5G with the needle moved in 20° in a reverse direction from the BDC position of FIG. 5A, back to a 340° position.
Figure 5I:
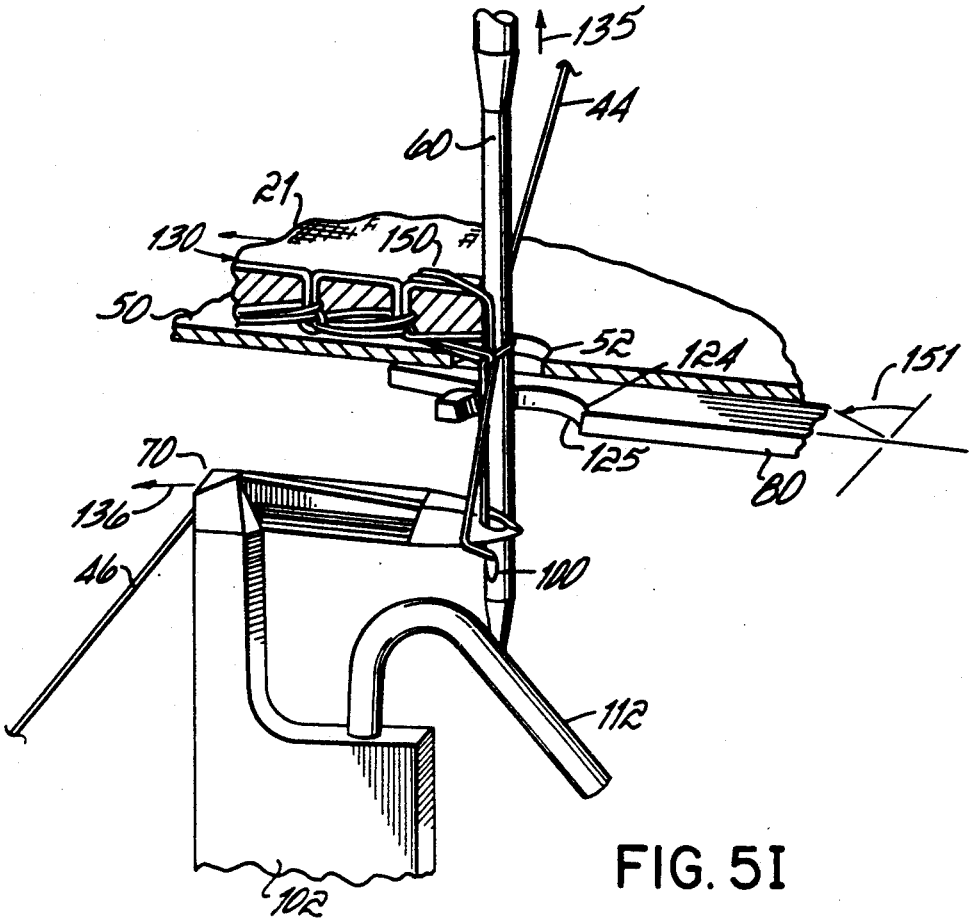
FIG. 5I is a view similar to FIG. 5H with the needle moved in 80° in a reverse direction from the BDC position of FIG. 5A, to a 280° position.
Figure 5J:
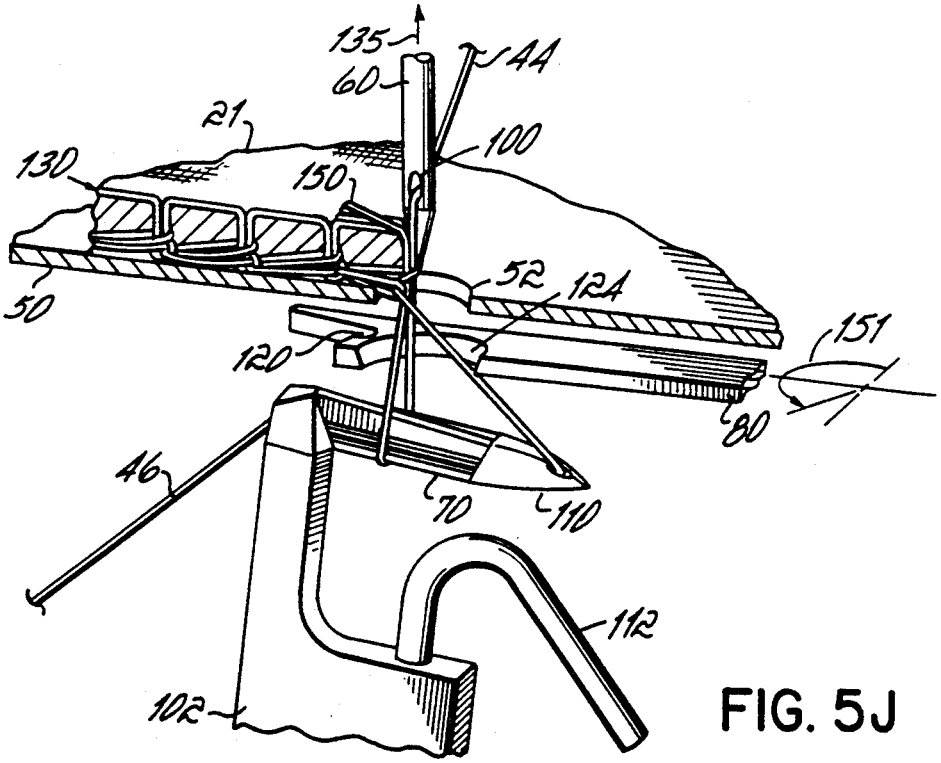
FIG. 5J is a view similar to FIG. 5H with the needle moved in 120° in a reverse direction from the BDC position of FIG. 5A, back to a 240° position.
Figure 5K:
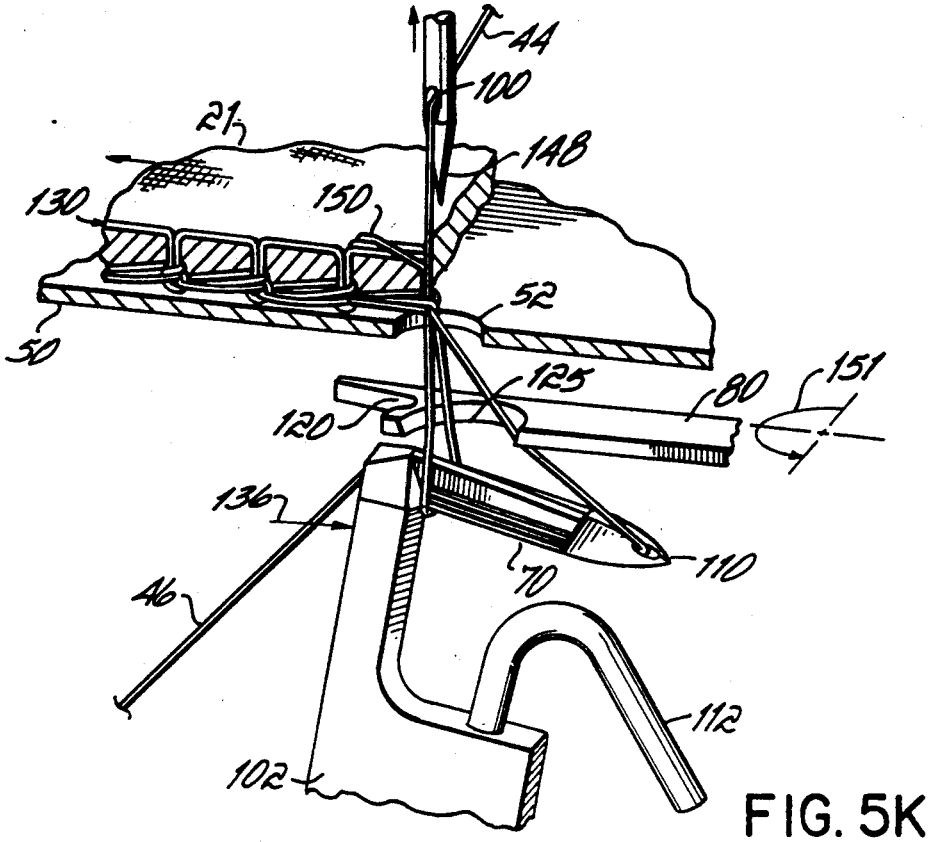
FIG. 5K is a view similar to FIG. 5H with the needle moved in 180° in a reverse direction from the BDC position of FIG. 5A, back to a 180°, or top dead center (TDC) position, with the needle fully up.

Then the mechanism 40 begins to reverse, through control of the drive motor 96 by the programmed controller 93, toward the 340° position of FIGS. 5H and 6H. In this reverse motion, the retainer 80 revolves in a counter-clockwise direction, as shown by the arrow 151. This motion continues through the 280° position of FIGS. 5I and 6I, at which the tip 110 of the looper 70 moves between the needle thread 44 and the needle 60, and through the 240° position shown in FIGS. 5J and 6J, at which the threads 44 and 46 enter the cutout 124 of the retainer 80. This motion continues to the 180° position, shown in FIGS. 5K and 6K at which the threads 44 and 46 are brought against the trimming surface or knife edge 125 of the crescent cut 124 on the retainer 80, at which point, the mechanism 40 stops, bringing to rest the stitch forming elements 60, 70 and 80, with the threads against the knife edge 125. Then the motor 96 is stopped to lock the stitching mechanism 40 with the needle in its TDC position.

Figure 5L:
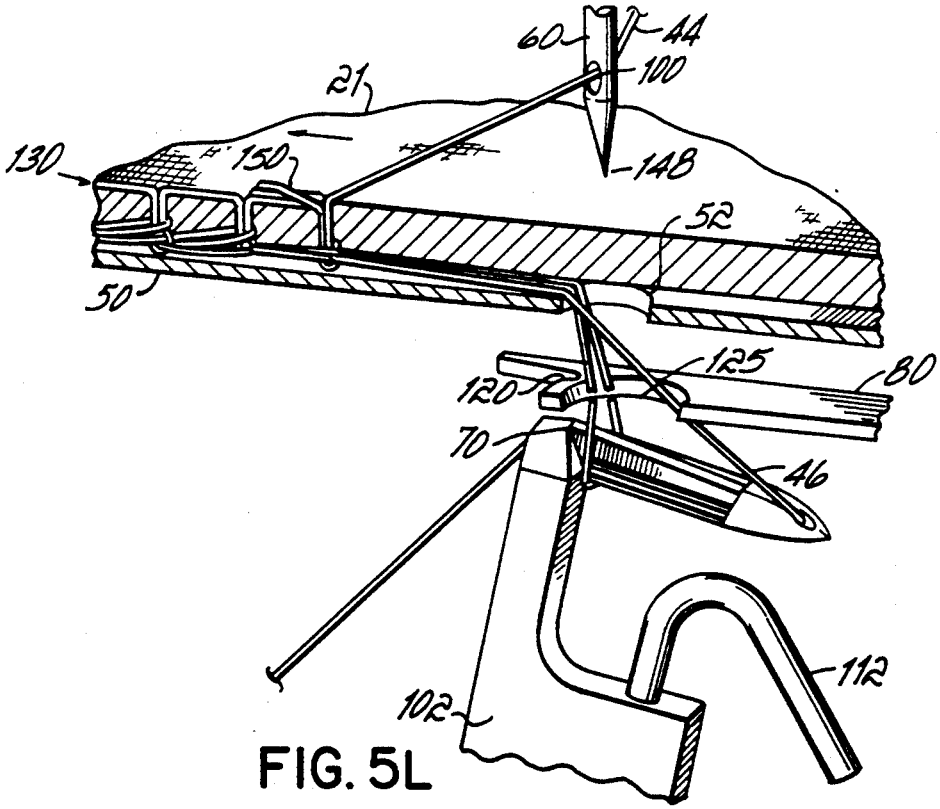
FIGS. 5L and 5M are cross-sectional elevational diagrams illustrating the motion of the fabric during the cutoff portion of the trimming cycle.

Then, the motor 90 is activated and the fabric is advanced downstream, as shown in FIG. 5L, while disconnected from the stitch forming mechanism 40, which remains stationary. At a point at which the fabric has moved a distance with respect to the needle 60 of, for example, 1¼", the thread tensioner actuators 48 or 48*a* are activated reimposing maximum tension on the threads 44. Preferably, only the tension of the needle thread 44 is reimposed by activation of the actuators 48 or 48*a*, so that only the needle thread 44 will be cut. However, in some applications, it may also be desirable to retention the looper thread 46 to cause it to be cut, by activating the looper thread tension actuators 49.

Figure 5M:
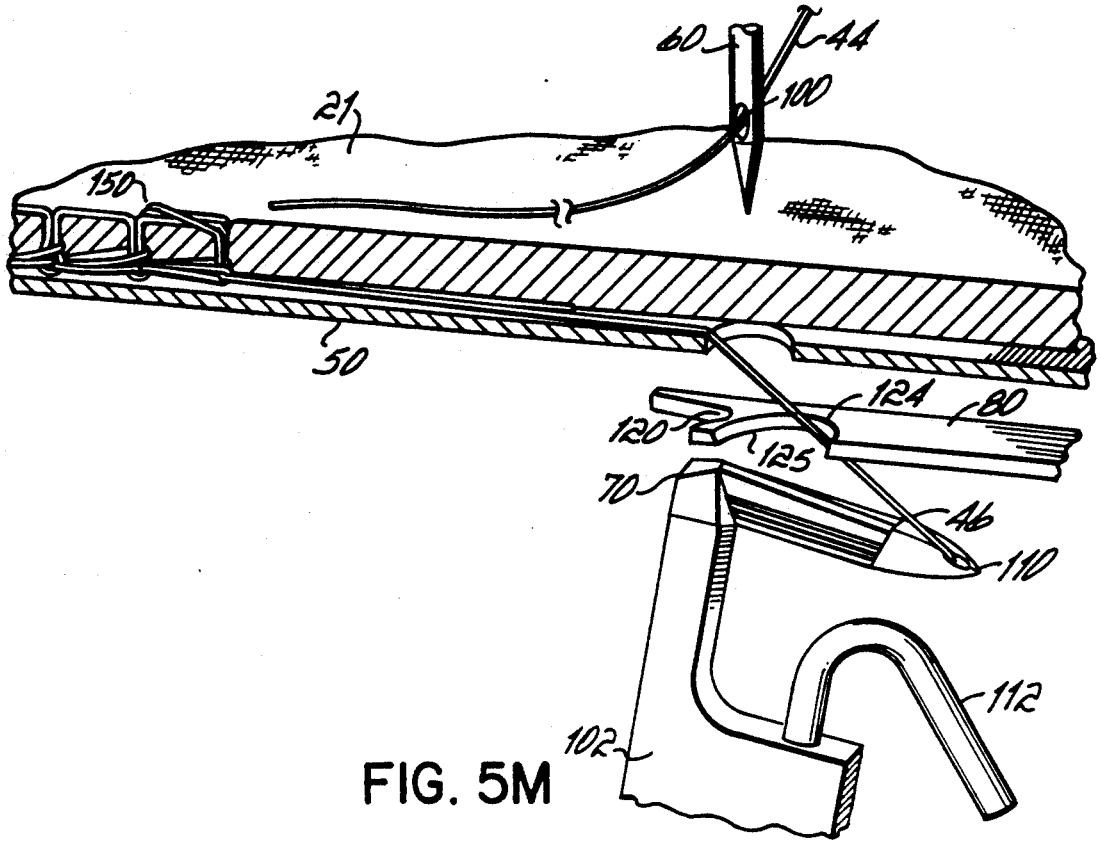

Then, as shown in FIG. 5M, the fabric 20 will continue to be advanced, to a total of from 2" to 12", pulling the tensioned thread against the knife edge 145 of the retainer 80, cutting the thread 44 from below the needle plate 50. The advancing is preferably achieved by controlled activation of the motor 90 and feed drive 88, and may also include activation of the motor 98 and transverse drive 89, to position the fabric 20 for the start of a new pattern. The cutting leaves sufficient thread length to prevent unthreading of the needle eyes 100, and leaves the tail of the thread on the back side of the quilt 21, where it will be inside of the bedding or furniture. The looper thread 46 need not be cut in such applications in that the underside of the quilt is not seen.

From the above description of the preferred embodiments of the invention, a thread trimming tack and jump method and apparatus accomplishes the objectives of the present invention, particularly for double lock chain stitch quilting with high density reconfigurable array multi-needle quilting machines. It will be apparent, however, to those skilled in the art that variations and modifications of the above may be made without departing from the principles of the present invention.

Accordingly, the following is claimed:

1. A method of manufacturing stitched fabric comprising the steps of:

providing a cyclically operable stitch forming mechanism including a plurality of mechanically linked stitch forming elements disposed on opposite sides of a fabric to be sewn and mechanically linked to move cyclically in synchronism, the elements including a needle having a thread supply associated therewith from which a thread extends through an eye in a tip thereof, and a cooperating element having a thread trimming surface thereon;

operating the mechanism in a first direction through a plurality of cycles and forming a stitch of the thread with the cooperating motion of the elements during each cycle thereof to thereby form an interconnected sequence of stitches in the fabric; and then, operating the mechanism in a second direction through at least a portion of a cycle and contacting the thread with the trimming surface to cut the thread.

2. The method of claim 1 wherein:

the second direction is the reverse of the first direction.

3. The method of claim 2 wherein:

the elements include a looper disposed on the opposite side of the fabric from the needle and having a looper thread supply associated therewith from which a looper thread extends through a guide therein;

the step of operating the mechanism in a first direction includes the step of forming lock chain stitches of the threads with the cooperating reciprocating motion of the needle and looper and a forward revolving motion of the cooperating element; and the step of operating the mechanism in a second direction includes the step of cutting thread with a backward revolving motion of the cooperating element.

4. The method of claim 3 wherein:

the cooperating element is a retainer having a thread deflecting surface thereon, and the stitch forming step includes the step of engaging at least one of the threads with the thread deflecting surface during the forward revolving motion of the retainer; and the thread is contacted with the trimming surface during the reverse revolving motion of the retainer.

5. The method of claim 4 wherein tension is maintained on the threads during the forward operation of the mechanism, the method further comprising the steps of:

after forming the interconnected sequence of stitches in the fabric and before operating the mechanism in the reverse direction, stopping the mechanism with the needle in a lowered position; then releasing the tension on the threads and performing the step of operating the mechanism in the reverse direction through approximately one half of a cycle to thereby raise the needle to an elevated position and move the trimming surface of the retainer against the thread to be cut; then after operating the mechanism through approximately one half cycle in the reverse direction:

moving the fabric a predetermined distance to advance the thread past the trimming surface, then applying tension to at least one thread to be cut and further moving the fabric to pull the thread to be cut against the trimming surface, thereby cutting the thread to be cut.

6. The method of claim 5 wherein the needle reciprocates on its axis, the method further comprising the steps of:

after forming the interconnected sequence of stitches in the fabric and before stopping the mechanism with the needle in a lowered position:

stopping the needle in an elevated position, locking the fabric against movement with respect to the axis of the needle, and advancing the mechanism forward through one half of a cycle to the lowered position.

7. The method of claim 1 wherein tension is maintained on the threads during the forward operation of the mechanism, the method further comprising the steps of:

after forming the interconnected sequence of stitches in the fabric, releasing the tension on the threads and performing the step of operating the mechanism in the second direction to thereby raise the needle to an elevated position and move the trimming surface of the retainer against the thread to be cut; then after operating the mechanism in the second direction:

moving the fabric a predetermined distance to advance the thread past the trimming surface, then applying tension to at least one thread to be cut and further moving the fabric to pull the thread to be cut against the trimming surface, thereby cutting the thread to be cut.

8. A method of manufacturing quilted fabric having an array of discrete chain lock stitched patterns comprising the steps of:

providing a cyclically operable lock chain stitch forming mechanism including a plurality of sets of stitch forming elements disposed in an array corresponding to an array of patterns to be stitched, each of the sets including:

a needle disposed on one side of a fabric to be quilted, each of the needles having a needle thread supply associated therewith and a needle thread extending from the needle thread supply through an eye in a tip of the needle, each of the needles of the sets being ganged to reciprocate in synchronism to simultaneously form a stitch with the needle thread in each of a corresponding plurality of patterns of the fabric during each cycle of operation of the mechanism, a looper disposed on the opposite side of the fabric from the needle, each of the loopers having a looper thread supply associated therewith and a looper thread extending from the looper thread supply through a guide in the looper, each of the loopers of the sets being ganged to reciprocate in synchronism to simultaneously form a lock stitch in cooperation with a needle in each of the corresponding plurality of patterns during each cycle of operation of the mechanism;

providing a plurality of thread trimming surfaces, one on each of a plurality of thread trimming elements, each located adjacent each of the sets in the array, the thread trimming elements being ganged to move in synchronism to move the thread trimming surfaces with respect to a thread at each set;

forming a discrete set of the patterns, including the steps of:

operating the mechanism through a plurality of cycles to form a plurality of lock chain stitched patterns in the fabric, one with each corresponding needle and looper;

then, contacting at least one thread of each set with the trimming surface of each adjacent trimming element, on the side of the fabric opposite the needle, and cutting at a thread therewith;

then positioning the fabric relative to each needle to bring each needle to a position adjacent the starting point of a new pattern; and repeating the pattern forming step to form a second set of discrete patterns of the array.

9. The method of claim 8 wherein:

each of the trimming elements has a thread guiding surface thereon and is mechanically linked to the mechanism to move in synchronism therewith; and the pattern forming step includes the step of forming each of the stitches with cooperating motion of the needle, looper and thread guiding surface.

10. The method of claim 9 wherein:

the thread trimming elements are moved in a first motion in which the thread guiding surfaces thereof contact the threads and in a second motion in which the thread trimming surfaces thereof contact the thread.

11. The method of claim lo wherein:

the mechanism is operated in a first direction to form the lock chain stitched patterns and to move the trimming elements in the first motion, and is operated in a second direction to move the trimming elements in the second motion.

12. The method of claim 11 wherein:

the second direction is the reverse of the first direction and the second motion is the reverse of the first motion.

13. The method of claim 8 further comprising the step of:

after contacting the threads with the trimming surfaces of the trimming elements, advancing the fabric with the needles retracted from the fabric to cut the threads against the trimming surfaces of the trimming elements.

14. The method of claim 13 further comprising the step of:

after contacting the threads with the trimming surfaces of the trimming elements, releasing the tension on the threads to be cut, then, while advancing the fabric with the needles retracted from the fabric, applying tension to the threads to be cut to thereby cut the threads against the trimming surfaces of the trimming elements.

15. An apparatus for manufacturing quilted fabric having an array of discrete identical lock chain stitched patterns sewn therein, the apparatus comprising:

a needle plate for supporting thereon a fabric to be quilted, the plate having a plurality of holes spaced thereon in an array corresponding to an array of patterns to be sewn;

a cyclically moveable stitching mechanism including a plurality of sets of cooperating lock chain stitch forming elements spaced thereon in an array corresponding to the array of patterns to be sewn, each of the sets including cooperating elements spaced on opposite sides of the plate in alignment with a corresponding hole of the array thereon;

each of the sets including a needle on a front side of the needle plate and a looper on the back side of the needle plate;

a plurality of thread trimming elements on the back side of the needle plate corresponding to a respective one of the sets and each having a thread trimming surface thereon; and fabric movement means selectively coupled to the stitch forming mechanism for moving the fabric relative to the sets of stitch forming and thread trimming elements for forming consecutive arrays of discrete patterns in the fabric and for cutting the threads therebetween.

16. The apparatus of claim 15 further comprising:

means for controlling the fabric movement means and the mechanism to operate the mechanism in a first direction through a plurality of cycles to form a pattern of a plurality of lock stitches in the fabric and then to operate the mechanism in a second direction through at least a portion of a cycle and contacting the thread with the trimming surface to cut the thread therewith, the thread trimming elements being mechanically linked to the mechanism to move cyclically therewith.

17. The apparatus of claim 16 wherein:

the thread trimming element is a retainer having a thread deflecting surface thereon engageable with a thread during the movement in the first direction.

18. The apparatus of claim 17 wherein:

the second direction is the reverse of the first direction.

19. The apparatus of claim 18 wherein:

the thread trimming elements are moveable in a first revolving motion in which the thread guiding surfaces thereof contact the threads and in a reverse revolving motion in which the thread trimming surfaces thereof contact the thread.

20. An apparatus for manufacturing stitched fabric comprising:

a cyclically operable stitch forming mechanism including a plurality of mechanically linked stitch forming elements disposed on opposite sides of a fabric to be sewn and mechanically linked to move cyclically in synchronism, the elements including a needle having a thread supply associated therewith from which a thread extends through an eye in a tip thereof, and a cooperating element having a thread trimming surface thereon;

the mechanism being operable in a first direction through a plurality of cycles to form a stitch of the thread with the cooperating motion of the elements during each cycle thereof to thereby form an interconnected sequence of stitches in the fabric, and in a second direction to contact the thread with the trimming surface to thereby cut the thread.

21. The apparatus of claim 20 wherein:

the second direction is the reverse of the first direction.

22. The apparatus of claim 21 wherein:

the elements include a looper disposed on the opposite side of the fabric from the needle and having a looper thread supply associated therewith from which a looper thread extends through a guide therein;

the mechanism being operable in the first direction to form lock chain stitches of the threads with cooperating reciprocating motion of the needle and looper and a forward revolving motion of the cooperating element; and the mechanism being operable in the second direction to cut the thread with a backward revolving motion of the cooperating element.

23. The apparatus of claim 22 wherein:

the cooperating element is a retainer having a thread deflecting surface thereon located so as to be engageable with at least one of the threads with the thread deflecting surface during the forward revolving motion thereof; and the thread trimming surface being located so as to engage at least one of the threads during the reverse revolving motion of the retainer.

24. The apparatus of claim 20 wherein:

the mechanism includes a plurality of moveable supports each having a matrix of element holders thereon in which the stitch forming and thread trimming elements can be selectively mounted in a plurality of corresponding positions corresponding to a plurality of selective pattern arrays.

* * * * *

UNITED STATES PATENT AND TRADEMARK OFFICE

CERTIFICATE OF CORRECTION

PATENT NO. : 5,154,130

DATED : October 13, 1992

INVENTOR(S) : Gribetz et al.

It is certified that error appears in the above-identified patent and that said Letters Patent is hereby corrected as shown below:

Col. 2, line 8, delete "desirably." and insert --desirable--

Col. 4, line 36, delete "FIG. 5B" (2nd occur) and insert --Fig. 5A--.

Col. 13, line 57, delete "claim lo" and insert --claim 10--

Signed and Sealed this

Twenty-fifth Day of January, 1994

*Attest:*

Bruce Lehman

BRUCE LEHMAN

*Attesting Officer*

*Commissioner of Patents and Trademarks*